US006733043B2

(12) United States Patent
Silverstein

(10) Patent No.: US 6,733,043 B2
(45) Date of Patent: May 11, 2004

(54) BOOK HOLDER

(76) Inventor: Harry P. Silverstein, 1725 Lombard St., Philadelphia, PA (US) 19146

( * ) Notice: Subject to any disclaimer, the term of this patent is extended or adjusted under 35 U.S.C. 154(b) by 0 days.

(21) Appl. No.: 09/847,972

(22) Filed: May 3, 2001

(65) Prior Publication Data

US 2002/0163177 A1 Nov. 7, 2002

(51) Int. Cl.[7] ..... B42D 3/00
(52) U.S. Cl. ..... 281/45; 281/42; 248/444.1
(58) Field of Search ..... 281/45, 42, 21.1, 281/15.1, 28; 402/80 R, 73, 70; 248/441.1, 451–453; 40/642, 658

(56) References Cited

U.S. PATENT DOCUMENTS

| | | | | | |
|---|---|---|---|---|---|
| 185,606 | A | | 12/1876 | Weston | |
| 267,812 | A | * | 11/1882 | Whitehead | 281/42 |
| 294,087 | A | * | 2/1884 | Small | 281/42 |
| 395,473 | A | | 1/1889 | Bartley | |
| 399,411 | A | | 3/1889 | Hyland | |
| 783,906 | A | * | 2/1905 | Spielman | 281/42 |
| 1,273,038 | A | | 7/1918 | Crowell | |
| 1,710,949 | A | | 4/1929 | Pokora | |
| 4,015,813 | A | | 4/1977 | Graham | 248/452 |
| 4,382,617 | A | | 5/1983 | Fortier | 281/42 |
| D269,443 | S | | 6/1983 | Million | D19/34 |
| 4,932,680 | A | | 6/1990 | Rivera | 281/42 |
| D322,459 | S | * | 12/1991 | Pimienta | 281/42 |
| 5,165,722 | A | | 11/1992 | Wong | 281/442 |

* cited by examiner

*Primary Examiner*—Willmon Fridie, Jr.
(74) *Attorney, Agent, or Firm*—Morgan, Lewis & Bockius LLP

(57) ABSTRACT

A book holder including an elongated, flexible formed piece of material, the material having an elastic deformation characteristic so as to permit bending while remaining biased to an original position, a base formed from the material, the base having a first member substantially transverse to a second member and a third member substantially transverse to the second member, the first, second, and third members lying in a plane, a first arm, having a first and second portion and a tip, formed from the material, the first portion extending from the first member generally perpendicular to the plane and the second portion extending obliquely from the first portion, the tip being on an end of the second portion opposite the first portion, a second arm, having a first and second portion and a tip, formed from the material, the first portion extending from the first member generally perpendicular to the plane and the second portion extending obliquely from the first portion, the tip being on an end of the second portion opposite the first portion wherein when the material surrounds the book in an open position, the base contacts a cover of the book and the tip of the first arm and the tip of the second arm each contact a page of the book, and when the book is in a closed position, the base contacts a first side of the cover, the first portion of the first arm and the first portion of the second arm contact a middle of the cover, and the tip of the first arm and the tip of the second arm contact a second side of the cover.

12 Claims, 3 Drawing Sheets

FIG. 1
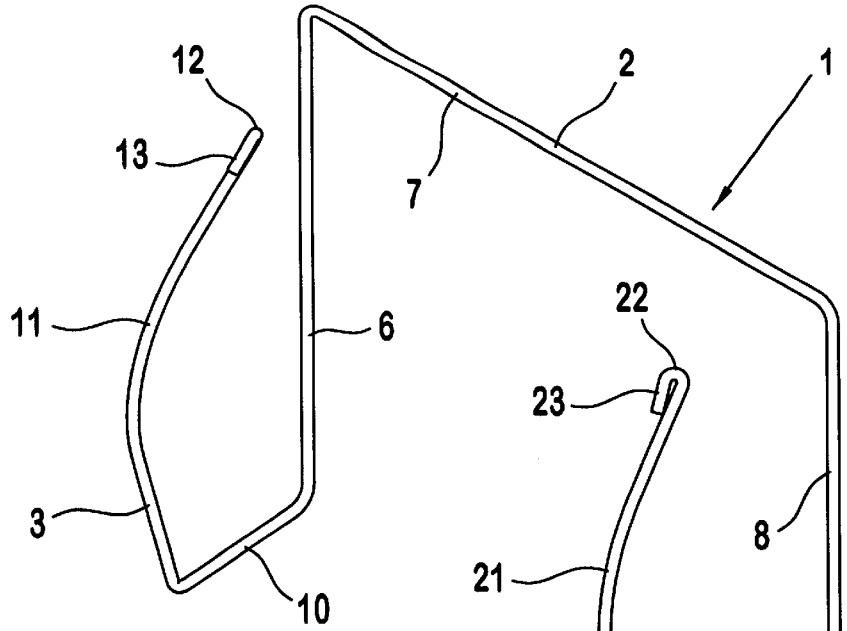
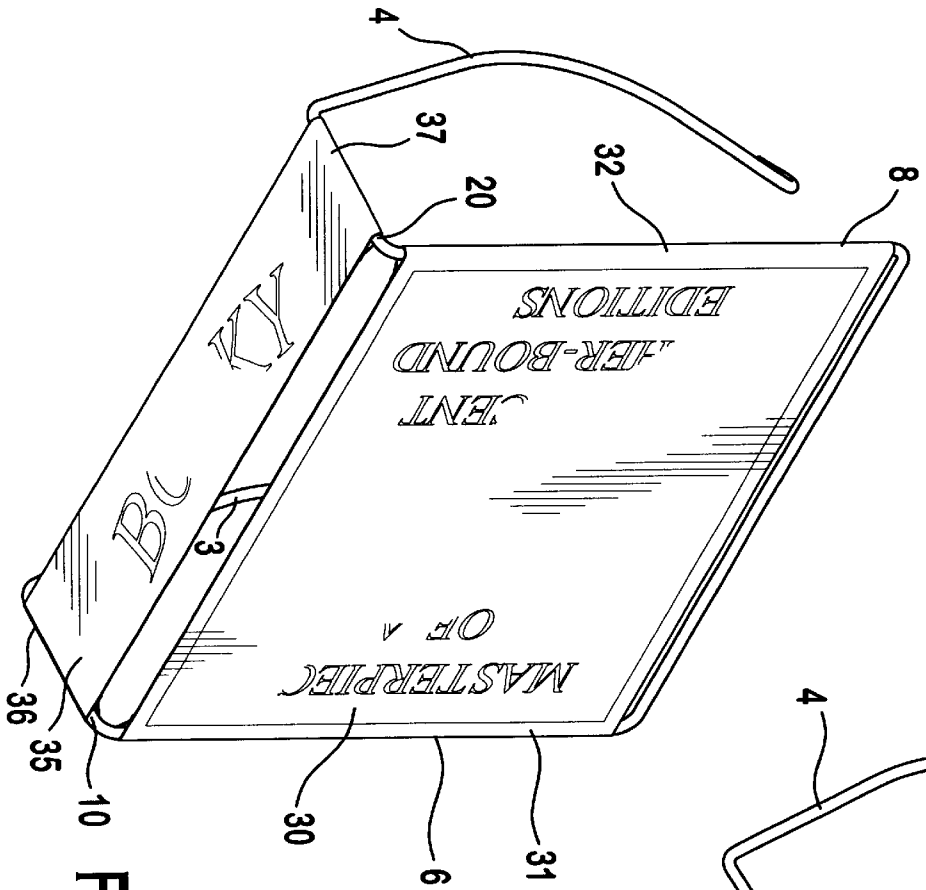
FIG. 2

BOOK HOLDER

FIELD OF THE INVENTION

This invention relates to the field of book holders and in particular to a book holder for holding a book in an open configuration.

BACKGROUND OF INVENTION

Book clips, or book holders, may assist readers in holding books open for hands-free or one-handed reading. These book clips may contact the pages from the sides of the book or in the middle of the book. These book clips may be bulky and difficult to transport such that they may not be useful when reading a book while traveling or outside of one's home. As a result, it may be desirable to have a book holder that both allows for hands-free and one-handed reading and is easily transportable.

SUMMARY OF THE INVENTION

The present invention provides a book holder. The book holder includes an elongated, flexible formed piece of material, a base formed from the material, a first arm, having a first and second portion and a tip, formed from the material, and a second arm, having a first and second portion and a tip, formed from the material. The material has an elastic deformation characteristic so as to permit bending while remaining biased to an original position. The base has a first member substantially transverse to a second member and a third member substantially transverse to the second member, where the first, second, and third members lie in a plane. The first portion of the first arm extends from the first member generally perpendicular to the plane and the second portion of the first arm extends obliquely from the first portion. The tip of the first arm is on an end of the second portion opposite the first portion. The first portion of the second arm extends from the first member generally perpendicular to the plane and the second portion of the second arm extends obliquely from the first portion. The tip of the second arm on an end of the second portion opposite the first portion. When the material surrounds the book in an open position, the base contacts a cover of the book and the tip of the first arm and the tip of the second arm each contact a page of the book. When the material surrounds the book in a closed position, the base contacts a first side of the cover, the first portion of the first arm and the first portion of the second arm contact a middle of the cover, and the tip of the first arm and the tip of the second arm contact a second side of the cover.

The present invention further provides another book holder. This book holder includes an elongated, flexible formed piece of material, a base formed from the material, a first arm, having a first and second portion and a tip, formed from the material, and a second arm, having a first and second portion and a tip, formed from the material. The material has an elastic deformation characteristic so as to permit bending while remaining biased to an original position. The base has a first member substantially transverse to a second member and a third member substantially transverse to the second member, where the first, second, and third members lie in a plane, and a wall lies in the plane and extends from the first member to the third member. The first portion of the first arm extends from the first member generally perpendicular to the plane and the second portion of the first arm extends obliquely from the first portion. The tip of the first arm is on an end of the second portion opposite the first portion and has a loop formed from a section of the second portion. The first portion of the second arm extends from the first member generally perpendicular to the plane and the second portion of the second arm extends obliquely from the first portion. The tip of the second arm is on an end of the second portion opposite the first portion and has a loop formed from a section of the second portion. A panel extends from the first portion of the first arm to the first portion of the second arm. The second portion of the first arm and the second portion of the second arm bend toward the plane such that the second portion of the first arm and the second portion of the second arm are concave to the base. When the material surrounds the book in an open position, the base contacts a cover of the book and the tip of the first arm and the tip of the second arm each contact a page of the book. When the material surrounds the book in a closed position, the base contacts a first side of the cover, the first portion of the first arm and the first portion of the second arm contact a middle of the cover, and the tip of the first arm and the tip of the second arm contact a second side of the cover.

The present invention also provides a method of holding a book in an open position. The method includes providing a book holder having a base, which is formed from an elongated, flexible formed piece of material, having a first member substantially transverse to a second member and a third member substantially transverse to the second member, where the first, second, and third members lie in a plane, a first arm, having a first and second portion and a tip, formed from the material and a second arm, having a first and second portion and a tip, formed from the material; opening the book; positioning the book such that a cover of the book lies within the plane and the first arm and second arm extend from the cover to a first page and a second page of the book, respectively; placing the first arm and the second arm over the first page and the second page, respectively; and sliding the book holder onto the book such that the first portion of the first arm and the first portion of the second arm contact at least one of the page and the cover. The first portion of the first arm extends from the first member generally perpendicular to the plane and the second portion of the first arm extends obliquely from the first portion. The tip of the first arm is on an end of the second portion opposite the first portion. The first portion of the second arm extends from the first member generally perpendicular to the plane and the second portion of the second arm extends obliquely from the first portion. The tip of the second arm is on an end of the second portion opposite the first portion.

The present invention further provides a method of holding a book in a closed position. The method includes providing a book holder having a base, formed from an elongated, flexible formed piece of material, having a first member substantially transverse to a second member and a third member substantially transverse to the second member, where the first, second, and third members lie in a plane, a first arm, having a first and second portion and a tip, formed from the material and a second arm, having a first and second portion and a tip, formed from the material; closing the book; positioning the base on a first side of a cover of the book; placing the first arm and the second arm over a second side of the cover; and sliding the book holder onto the book such that the first portion of the first arm and the first portion of the second arm contact at least one of a middle of the cover and ends of the cover. The first portion of the first arm extends from the first member generally perpendicular to the plane and the second portion of the first arm extends obliquely from the first portion. The tip of the first arm is on an end of the second portion opposite the first portion. The first portion of the second arm extends from the first member generally perpendicular to the plane and the second portion of the second arm extends obliquely from the first portion. The tip of the second arm is on an end of the second portion opposite the first portion.

BRIEF DESCRIPTION OF THE DRAWINGS

The accompanying drawings, which are incorporated herein and constitute part of this specification, illustrate the presently preferred embodiment of the invention, and, together with the general description given above and the detailed description given below, serve to explain the features of the invention.

FIG. 1 is a front side perspective view of a preferred embodiment of the book holder of the present invention.

FIG. 2 is a rear bottom perspective view of an alternative embodiment of the book holder of the present invention.

DETAILED DESCRIPTION OF THE PREFERRED EMBODIMENTS

Figure 3:
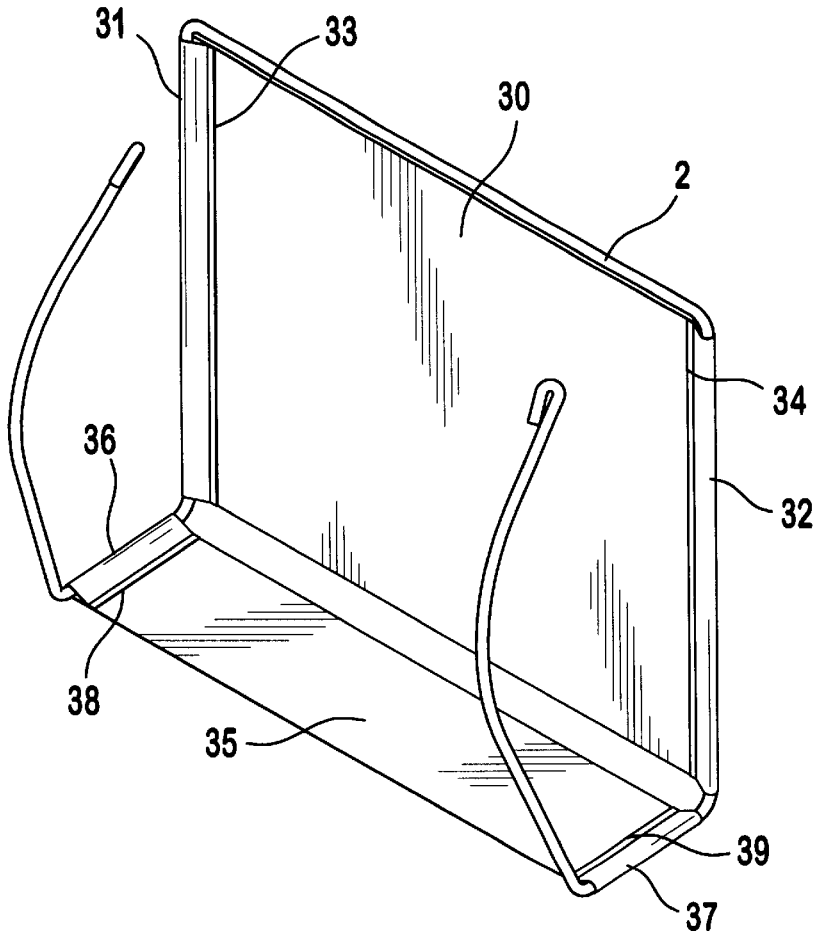
FIG. 3 is a front side perspective view of the alternative embodiment of FIG. 2.

Reference will now be made in detail to the preferred embodiments of the present invention, examples of which are illustrated in the accompanying drawings. It is to be understood that the Figures and descriptions of the present invention included herein illustrate and describe elements that are of particular relevance to the present invention, while eliminating, for purposes of clarity, other elements found in typical books.

FIG. 1 illustrates the book holder 1 with a base 2, a first arm 3 and a second arm 4 formed from an elongated, flexible piece of material that has an elastic deformation characteristic. This characteristic permits bending, while remaining biased to an original position. The material may be metal or any other suitable material.

The base 2, has a first member 6, a second member 7, and a third member 8. The first member 6 is substantially transverse to the second member 7, and the second member 7 is substantially transverse to the third member 8. Preferably, the first member 6 is substantially perpendicular to the second member 7 and the second member 7 is substantially perpendicular to the third member 8. The first, second and third members 6, 7, and 8 lie in a plane.

The first arm 3 has a first portion 10, a second portion 11, and a tip 12. The first portion 10 extends from the first member 6 generally perpendicular to the plane, and the second portion 11 extends obliquely from the first portion 10. Preferably, the second portion 11 bends toward the plane such that the second portion 11 is concave to the base 2. The tip 12 is located on an end of the second portion 11 opposite the first portion 10. In the preferred embodiment, the tip 12 has a loop 13 formed from a section of second portion 11.

The second arm 4 has a first portion 20, a second portion 21, and a tip 22. The first portion 20 extends from the first member 6 generally perpendicular to the plane, and the second portion 21 extends obliquely from the first portion 20. Preferably, the second portion 21 bends toward the plane such that the second portion 21 is concave to the base 2. The tip 22 is located on an end of the second portion 21 opposite the first portion 20. In the preferred embodiment, the tip 22 has a loop 23 formed from a section of second portion 21.

In an alternative embodiment, as shown in FIG. 2, the base 2 includes a wall 30 that lies in the plane and extends from the first member 6 to the third member 8. Preferably, a first end 31 of the wall 30 surrounds the first member 6 and a second end 32 of the wall 30 surrounds the second member 8. The first end 31 may contact a first portion 33 of the wall 30 and the second end 32 may contact a second portion 34 of the wall 30, as shown in FIG. 3. The first end 31 and second end 32 may be sealed or otherwise affixed to the first portion 33 and second portion 34, respectively, to hold the wall 30 in place within the base 2.

The alternative embodiment of FIG. 2 also has a panel 35 that extends from the first portion 10 of the first arm 3 to the first portion 20 of the second arm 4. Preferably, a first end 36 of the panel 35 surrounds the first portion 10 and a second end 37 of the panel 35 surrounds the first portion 20. The first end 36 may contact a first surface 38 of the panel 35 and the second end 37 may contact a second surface 39 of the panel 35, as shown in FIG. 3. The first end 36 and second end 37 may be sealed or otherwise affixed to the first surface 38 and second surface 39, respectively, to hold the panel 35 in place.

The wall 30 and panel 35 may be made of paper, plastic, or other suitable material and may contain an advertisement, title, author, or other information that may be desired. The information may be printed or written matter on at least one side of the wall 30 and panel 35. The wall 30 may also have a pocket for insertion of printed or written matter, such as advertisements or notes, which may be interchanged at various times. For example, the wall 30 may be made of clear plastic and have a pocket with a paper having an advertisement inserted therein. The user may replace the advertisement with other information that may be desired.

Figure 4:
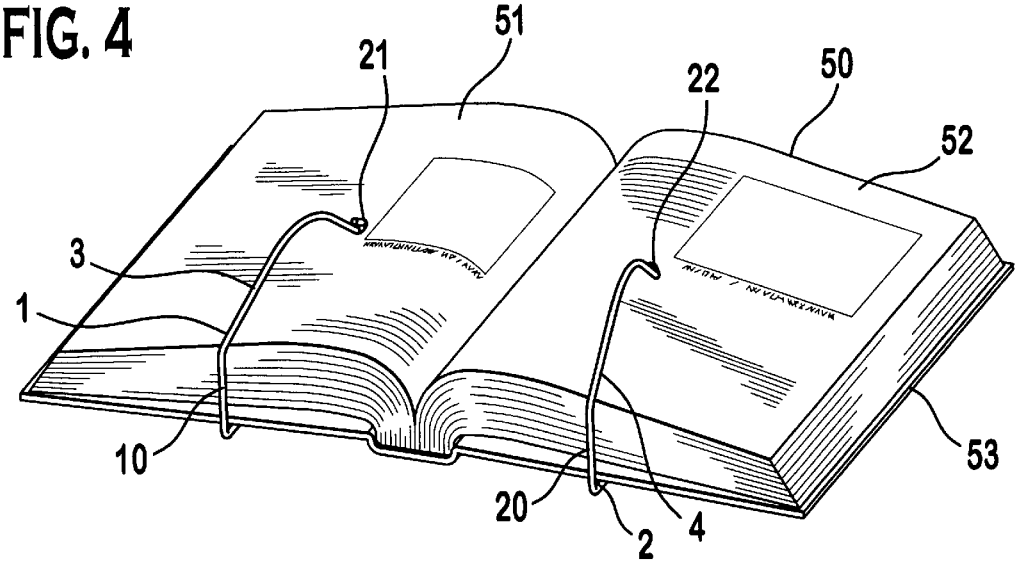
FIG. 4 is a front bottom view of the book holder of FIG. 1 surrounding a book in an open position.
Figure 5:
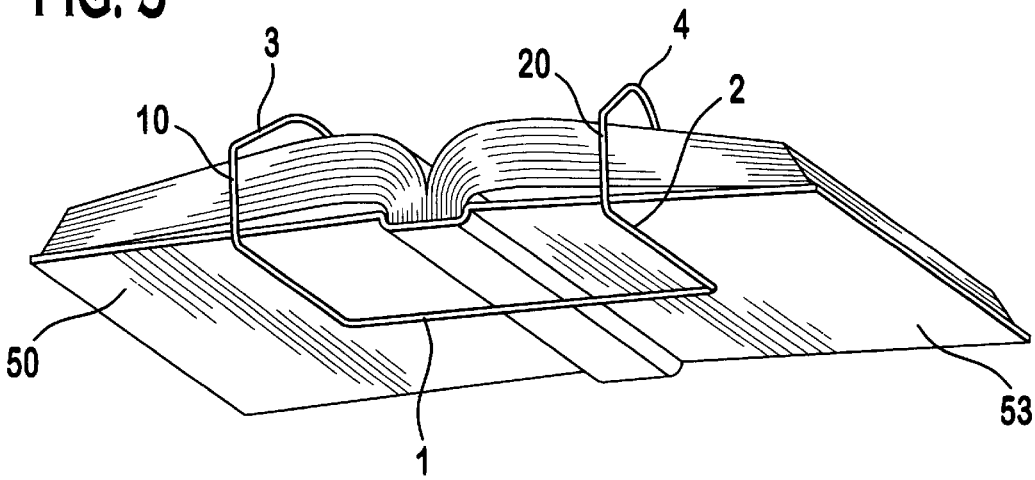
FIG. 5 is a back bottom view of the book holder of FIG. 4.

The book holder 1 may be used to hold a book 50 in an open position, as shown in FIGS. 4 and 5. The book holder 1 provides a hands-free method for a user to read the book 50 by keeping the book 50 open to a desired page. This method is particularly useful if the user is taking notes while reading the book 50. To use the book holder 1, the user opens the book 50 to a desired page or pages 51 and 52. The book 50 is then positioned, or moved, such that a cover 53 of the book 50 lies within the plane of the base 2. The first arm 3 and second arm 4 extend from the cover 53 to the first page 51 and second page 52, respectively. Preferably, the tips 12 and 22 contact the pages 51 and 52, respectively.

The first arm 3 and second arm 4 are then placed over the first page 51 and the second page 52, respectively. Finally, the book holder 1 is slid onto the book 50 such that the first arm 3 and the first portion 10 and first portion 20 contact the pages 51 and 52, respectively, or the cover 53.

Figure 6:
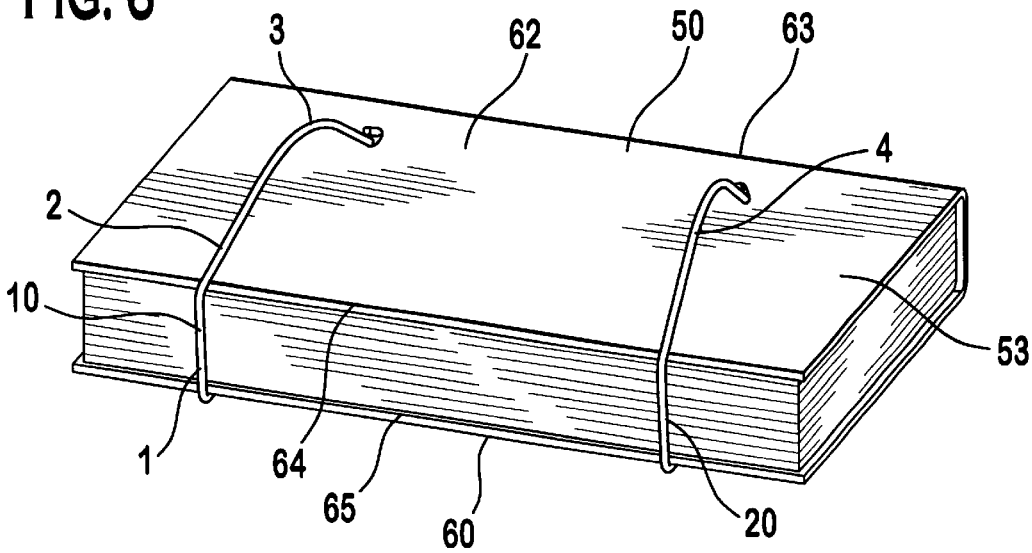
FIG. 6 is a front bottom perspective view of the book holder of FIG. 1 surrounding the book in a closed position.

The book holder 1 may also be used to hold the book 50 in a closed position, as shown in FIG. 6. The book holder 1 may be easily carried with the book 50. To hold the book 50 in the closed position, the book 50 is closed and the base 2 is positioned on a first side 60 of the cover 53. The first arm 3 and second arm 4 are placed over a second side 62 of the cover 53. The book holder 2 is then slid onto the book 50 such that the first portion 10 and the first portion 20 contact a middle 63 of the cover 53 (not shown) or ends 64 and 65 of the cover 53.

While the invention has been described in detail and with reference to specific features, it will be apparent to one skilled in the art that various changes and modifications can be made therein without departing from the spirit and scope of the invention. It is intended that the present invention cover the modifications and variations of this invention provided they come within the scope of the appended claims and their equivalents.

What is claimed is:

1. A book holder comprising:

an elongated, flexible formed piece of material, the material having an elastic deformation characteristic so as to permit bending while remaining biased to an original position;

a base formed from the material, the base having a first member substantially transverse to a second member and a third member substantially transverse to the second member, the first, second, and third members lying in a plane;

a first arm, having a first and second portion and a tip, formed from the material, the first portion extending from the first member generally perpendicular to the plane and the second portion extending obliquely from the first portion, the tip being on an end of the second portion opposite the first portion; and a second arm, having a first and second portion and a tip, formed from the material, the first portion extending from the first member generally perpendicular to the plane and the second portion extending obliquely from the first portion, the tip being on an end of the second portion opposite the first portion;

wherein when the material surrounds the book in an open position, the base contacts a cover of the book and the tip of the first arm and the tip of the second arm each contact a page of the book, and when the book is in a closed position, the base contacts a first side of the cover, the first portion of the first arm and the first portion of the second arm contact a middle of the cover, and the tip of the first arm and the tip of the second arm contact a second side of the cover; and wherein the second portion of the first arm and the second portion of the second arm bend toward the plane such that the second portion of the first arm and the second portion of the second arm are concave to the base.

2. The book holder of claim 1 wherein the tips comprise a loop formed from a section of the second portion.

3. The book holder of claim 1 wherein the material comprises metal.

4. The book holder of claim 1 wherein the base comprises a wall extending from the first member to the third member.

5. The book holder of claim 4 wherein a first end of the wall surrounds the first member and a second end of the wall surrounds the second member such that the first end contacts a first portion of the wall and the second end contacts a second portion of the wall.

6. The book holder of claim 1 wherein a panel extends from the first portion of the first arm to the first portion of the second arm.

7. The book holder of claim 6 wherein a first end of the panel surrounds the first portion of the first arm and a second end of the panel surrounds the first portion of the second arm such that the first end contacts a first surface of the panel and the second end contacts a second surface of the panel.

8. The book holder of claim 1 wherein a panel extends from the first portion of the first arm to the first portion of the second arm, the panel having printed matter on at least one side.

9. The book holder of claim 1 wherein the second portion of the first arm and the second portion of the second arm are biased toward the base.

10. A book holder comprising:

an elongated, flexible formed piece of material, the material having an elastic deformation characteristic so as to permit bending while remaining biased to an original position;

a base formed from the material, the base having a first member substantially transverse to a second member and a third member substantially transverse to the second member, the first, second, and third members lying in a plane;

a first arm, having a first and second portion and a tip, formed from the material, the first portion extending from the first member generally perpendicular to the plane and the second portion extending obliquely from the first portion, the tip being on an end of the second portion opposite the first portion; and a second arm, having a first and second portion and a tip, formed from the material, the first portion extending from the first member generally perpendicular to the plane and the second portion extending obliquely from the first portion, the tip being on an end of the second portion opposite the first portion;

wherein when the material surrounds the book in an open position, the base contacts a cover of the book and the tip of the first arm and the tip of the second arm each contact a page of the book, and when the book is in a closed position, the base contacts a first side of the cover, the first portion of the first arm and the first portion of the second arm contact a middle of the cover, and the tip of the first arm and the tip of the second arm contact a second side of the cover; and wherein the base comprises a wall lying in the plane.

11. A book holder comprising:

an elongated, flexible formed piece of material, the material having an elastic deformation characteristic so as to permit bending while remaining biased to an original position;

a base formed from the material, the base having a first member substantially transverse to a second member and a third member substantially transverse to the second member, the first, second, and third members lying in a plane;

a first arm, having a first and second portion and a tip, formed from the material, the first portion extending from the first member generally perpendicular to the plane and the second portion extending obliquely from the first portion, the tip being on an end of the second portion opposite the first portion; and a second arm, having a first and second portion and a tip, formed from the material, the first portion extending from the first member generally perpendicular to the plane and the second portion extending obliquely from the first portion, the tip being on an end of the second portion opposite the first portion;

wherein when the material surrounds the book in an open position, the base contacts a cover of the book and the tip of the first arm and the tip of the second arm each contact a page of the book, and when the book is in a closed position, the base contacts a first side of the cover, the first portion of the first arm and the first portion of the second arm contact a middle of the cover, and the tip of the first arm and the tip of the second arm contact a second side of the cover; and wherein the base comprises a wall lying in the plane, the wall having printed matter on at least one side.

12. A book holder comprising:

an elongated, flexible formed piece of material, the material having an elastic deformation characteristic so as to permit bending while remaining biased to an original position;

a base formed from the material, the base having a first member substantially transverse to a second member and a third member substantially transverse to the second member, the first, second, and third members lying in a plane;

a wall lying in the plane and extending from the first member to the third member;

a first arm, having a first and second portion and a tip, formed from the material, the first portion extending from the first member generally perpendicular to the plane and the second portion extending obliquely from the first portion, the tip being on an end of the second portion opposite the first portion and having a loop formed from a section of the second portion;

a second arm, having a first and second portion and a tip, formed from the material, the first portion extending from the first member generally perpendicular to the plane and the second portion extending obliquely from the first portion, the tip being on an end of the second portion opposite the first portion and having a loop formed from a section of the second portion;

a panel extending from the first portion of the first arm to the first portion of the second arm;

wherein the second portion of the first arm and the second portion of the second arm bend toward the plane such that the second portion of the first arm and the second portion of the second arm are concave to the base; and wherein when the material surrounds the book in an open position, the base contacts a cover of the book and the tip of the first arm and the tip of the second arm each contact a page of the book, and when the book is in a closed position, the base contacts a first side of the cover, the first portion of the first arm and the first portion of the second arm contact a middle of the cover, and the tip of the first arm and the tip of the second arm contact a second side of the cover.

* * * * *